US006604695B1

(12) United States Patent
Parish

(10) Patent No.: US 6,604,695 B1
(45) Date of Patent: Aug. 12, 2003

(54) METHOD AND FUEL INJECTOR FOR SETTING GASEOUS INJECTOR STATIC FLOW RATE WITH INJECTOR STROKE

(75) Inventor: James Robert Parish, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 36 days.

(21) Appl. No.: 09/669,428

(22) Filed: Sep. 25, 2000

(51) Int. Cl.[7] ..... F02M 63/00

(52) U.S. Cl. ..... 239/533.2; 239/88; 239/96; 239/533.3; 239/533.9; 239/533.12; 239/533.11; 239/585.1

(58) Field of Search ..... 239/88–96, 533.2–533.12, 239/585.1–585.5

(56) References Cited

U.S. PATENT DOCUMENTS

| | | | | |
|---|---|---|---|---|
| 5,141,164 A | | 8/1992 | Ohno et al. | 239/585.2 |
| 5,170,945 A | * | 12/1992 | Daly et al. | 239/497 |
| 5,484,108 A | | 1/1996 | Nally | 239/553.3 |
| 5,570,841 A | | 11/1996 | Pace et al. | 239/585.1 |
| 5,671,890 A | | 9/1997 | Cooper et al. | 239/533.7 |
| 5,730,367 A | | 3/1998 | Pace et al. | 239/408 |
| 5,775,599 A | | 7/1998 | Smith et al. | 239/585.3 |
| 5,853,124 A | * | 12/1998 | Beck et al. | 239/5 |
| 5,921,475 A | | 7/1999 | DeVriese et al. | 239/585.4 |
| 6,027,050 A | | 2/2000 | Rembold et al. | 239/585.5 |
| 6,405,947 B2 | | 6/2002 | Fochtman | 239/585.4 |
| 2001/0017327 A1 | * | 8/2001 | Fochtman | 239/585.4 |

FOREIGN PATENT DOCUMENTS

| | | |
|---|---|---|
| DE | 37 24217 | 2/1989 |
| DE | 297 06 625 | 9/1997 |

OTHER PUBLICATIONS

PCT/US01/26138; International Search Report; Jan. 29, 2002.

* cited by examiner

*Primary Examiner*—Robin O. Evans

(57) ABSTRACT

A fuel injector having a fuel flow rate set by injector stroke is disclosed. The fuel injector includes a housing having a hollow passage and a seat disposed at one end of the hollow passage. A needle is slidably mounted in the hollow passage. The needle is operable between a first position wherein the needle engages the seat and a second position wherein the needle is disposed away from the seat. A first flow area is formed by a minimum frusto-conical area between the seat and the needle when the needle is disposed away from the seat. The fuel injector also includes an opening at the one end of the hollow passage proximate to the seat. The opening has a second flow area larger than the first flow area. A method for setting a gaseous fuel injector flow rate with injector stroke is also disclosed.

16 Claims, 3 Drawing Sheets

METHOD AND FUEL INJECTOR FOR SETTING GASEOUS INJECTOR STATIC FLOW RATE WITH INJECTOR STROKE

FIELD OF THE INVENTION

The present invention relates to a fluid valve, and more particularly, to a fuel injector for an internal combustion engine which meters fuel with injector stroke.

BACKGROUND OF THE INVENTION

Fuel injectors are used to precisely and accurately regulate the flow of fuel into the combustion chamber of an engine based on several parameters, such as engine speed, engine load and fuel density. Typically, an electronic fuel injection system uses a solenoid-actuated needle valve comprised of a needle and a seat to allow passage of fuel into the combustion chamber. The needle valve cooperates with an orifice to regulate the flow of fuel through the injector.

In known injectors, the needle is lifted away from the seat by an electronically controlled solenoid (not shown) to open the orifice. The amount the needle is lifted away from the surface is called injector lift or stroke. The maximum static flow rate of a fluid through a passage is determined by the sum total of all of the pressure drops experienced by the fluid as it travels through the injector. There are typically two areas in the conventional fuel injector where the fluid flow can meet significant pressure drops. The pressure drops at these two areas could ultimately control the maximum static flow rate.

One area in a conventional injector is the cross-sectional area at the orifice. The orifice, conventionally, may be provided as a precise hole in the seat, or by a thin edge orifice plate placed downstream of the seat. The other area is represented by an annular frusto-conical area extending between the seat surface and the end surface of the needle. This annular frusto-conical area is directly related to the injector stroke.

The relationship between injector stroke and flow rate for a given orifice size where the orifice is used to regulate the maximum flow rate is termed lift sensitivity. The flow rate changes significantly at small injector strokes (less than approximately 0.140 millimeters). The flow rate is substantially independent of injector stroke at large strokes (typically greater than approximately 0.200 millimeters). In the transition region (approximately 0.140 millimeters to 0.200 millimeters), flow rate is determined by both the orifice and the injector stroke.

For small injector stroke, a slight variation in manufacturing tolerances during the assembly of the needle relative to the seat dramatically affects the flow rate. Other factors, such as wear in the needle or wear in the seat, can exacerbate this effect. This variation in the static flow rate is contrary to the purpose of a fuel injector, which is to provide accurate and precise fuel delivery to the combustion chamber. A known fuel injector is designed by first determining the desired output flow rate. Next, the orifice is sized to limit the flow rate to the desired value. The stroke is then set at a value that permits a flow rate that is greater than that permitted by the orifice.

Until recently, only liquid fuels have been used in internal combustion engines. However, environmental and natural resource concerns have introduced gaseous fuels to internal combustion engines. Gaseous fuels are generally less dense than liquid fuels. Therefore, a higher flow rate is needed to provide the same amount of fuel as compared to a liquid fuel system. Traditionally, the size of the orifice is increased, as compared to a liquid fuel injector, to provide this increased flow rate. A corresponding substantial increase in the injector stroke is required to prevent the frusto-conical area between the needle and the seat from influencing the flow rate. Substantially increased stroke introduces versatility, performance, durability and noise concerns to a fuel injector design.

However, it would be desirable to design a fuel injector in which the stroke alone determines the fuel flow rate. It would also be desirable to be able to design and manufacture fuel injectors with common components, but with different operational characteristics in which different strokes provide different fuel flow rates. The operational characteristics of a particular injector are determined by the manner in which the components are installed in the injector and interrelationships between components. Such designs facilitate mass-production assembly and reduce costs.

SUMMARY OF THE INVENTION

Briefly, the present invention provides a fuel injector comprising a housing having a hollow passage, a longitudinal axis extending through the hollow passage and a seat disposed at one end of the hollow passage. A needle is slidably mounted in the hollow passage and operable between a first position wherein the needle engages the seat and a second position wherein the needle is disposed away from the seat. A first flow area is formed by a minimum frusto-conical area between the seat and the needle when the needle is disposed away from the seat. The fuel injector also comprises an opening at the one end of the hollow passage proximate to the seat. The opening has a second flow area larger than the first flow area.

The present invention also provides a method for assembling a fuel injector having a housing and a valve disposed within the housing, the valve including a seat having an opening and a needle. The method comprises determining a desired fuel flow rate for the injector; providing the opening to permit a fuel flow rate greater than the desired fuel flow rate; and setting an injector stroke of the needle required to provide the desired flow rate.

The present invention also provides a method for generating different flow rates from each of a plurality of fuel injectors. The method comprises providing substantially uniformly dimensioned components for each of the plurality of fuel injectors; determining a desired respective gaseous flow rate for each of the plurality of fuel injectors; determining an injector stroke respective to each of the plurality of fuel injectors to provide the respective flow rate; and securing the components of the first of the plurality of fuel injectors in a first position to obtain a first injector stroke and securing the components of the second of the plurality of fuel injectors in a second position to obtain a second injector stroke.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Figure 1:
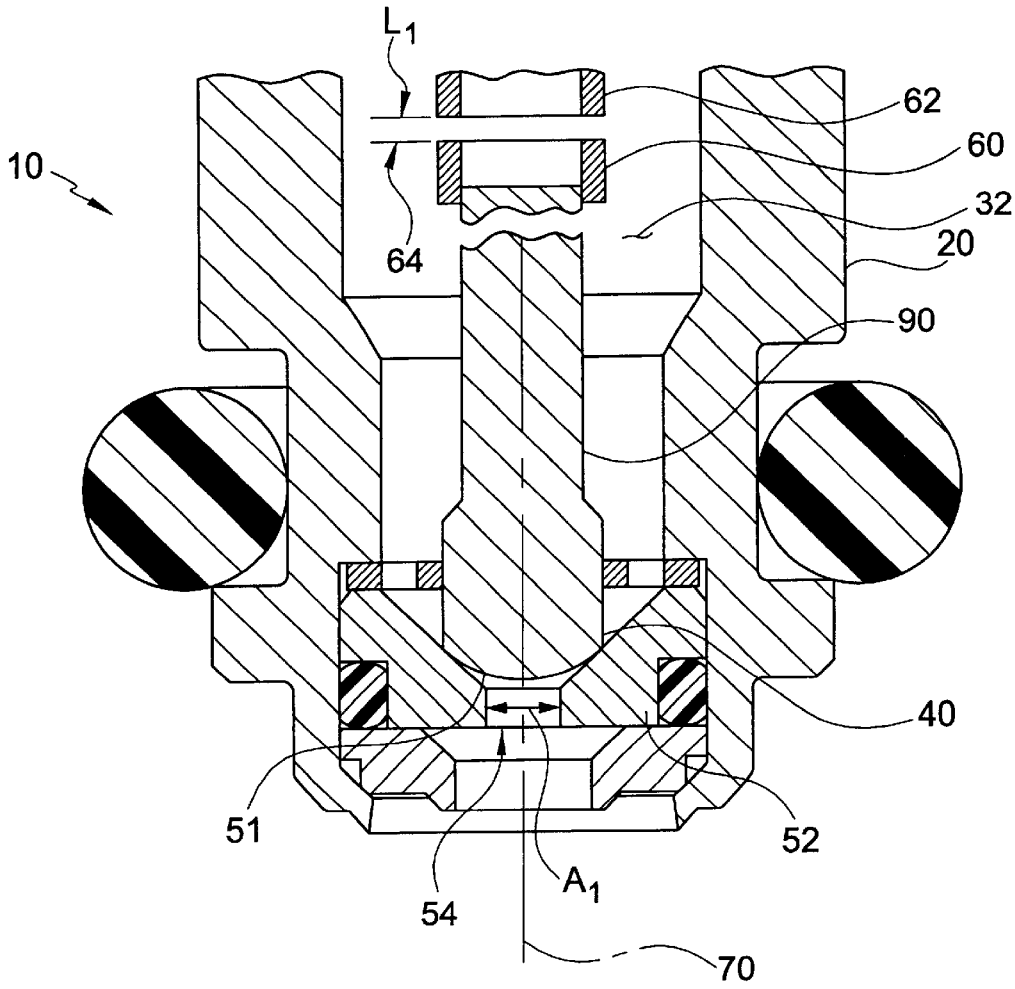
FIG. 1 is a partial view, in section, of a first fuel injector according to the invention.

Reference will now be made in the detail to the preferred embodiments of the present invention, examples of which are illustrated in the accompanying drawings. FIG. 1 illustrates a partial view of a first gaseous fuel injector 10 according to the invention. Preferably, the gas used is compressed natural gas, although those skilled in the art will recognize that other types of gaseous fuels can be used. The fuel injector 10 includes a housing 20 having a passage 32 and a valve 40 slidably disposed within the passage 32. The valve 40 is comprised of a needle 50 having an end 51 and a seat 52 disposed at an end of the passage 32, and an opening 54 having a cross-sectional area $A_1$. The needle 50 is operable between a first, or closed position, wherein the needle 50 engages the seat 52, and a second, or open position wherein the needle 50 is disposed away from the seat 52. In this embodiment, the opening 54 is formed in the seat 52.

The fuel injector also includes an armature 60 connected to the needle 50, and an inlet tube 62 located upstream of the armature 60. The armature 60 and the inlet tube 62 are separated by a gap 64. The needle 50 and armature 60 are reciprocable along a longitudinal axis 70 of the injector 10. Typically, injector lift or stroke $L_1$ is set by setting the gap 64 between the inlet tube 62 and the armature 60 such that when the injector solenoid (not shown) is actuated, the armature 60 is drawn upward through the gap 64 until the armature 60 impacts the inlet tube 62. To decrease the injector stroke $L_1$, the inlet tube 62 is moved closer to the armature 60 when the needle 50 is engaged with the seat 52, reducing the gap 64. Conversely, to increase the injector stroke $L_1$, the inlet tube 62 is moved farther from the armature 60 when the needle 50 is engaged with the seat 52, enlarging the gap 64. As a result, using parts with substantially uniform dimensions, injectors with different injector strokes can be manufactured, simply by adjusting the size of the gap 64.

Figure 2:
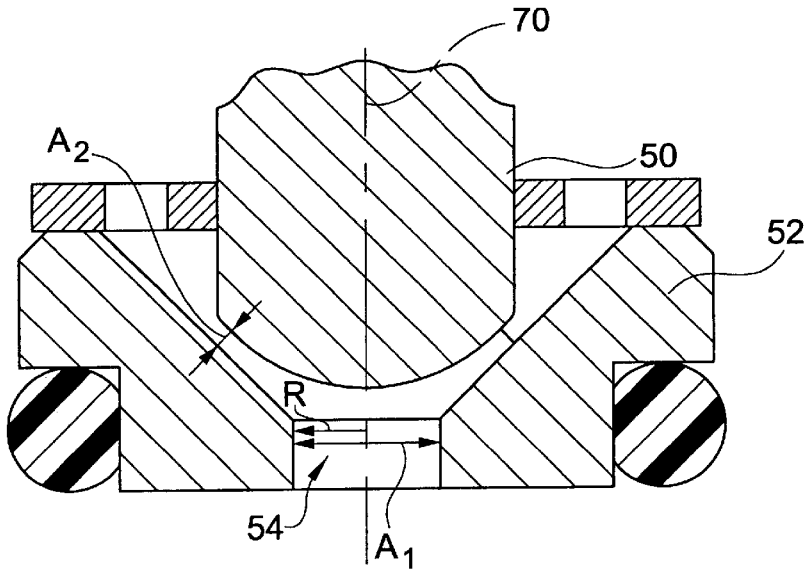
FIG. 2 is an enlarged view, in section, of the discharge end of the first fuel injector in an open position.

The valve 40 is shown in the opened position in enlarged FIG. 2. When the valve 40 is in the opened position, a frusto-conical cross-sectional area $A_2$ is formed between the end 51 of the needle 50 and the seat 52. The frusto-conical cross-sectional area $A_2$ is defined as the locus of lines having a minimum area between the end 51 of the needle 50 and the seat 52. This frusto-conical area $A_2$ is substantially smaller than the cross-sectional area $A_1$ of the opening 54. Preferably, the frusto-conical area $A_2$ is approximately two times smaller than the cross-sectional area $A_1$ of the opening 54. Correspondingly, the pressure drop induced by the frusto-conical area $A_2$ is significantly greater than the pressure drop induced by the area $A_1$ of the opening 54. Therefore, the frusto-conical area $A_2$ determines the maximum flow rate through the injector 10.

The flow area of a frusto-conical area $A_2$ is determined by the equation $$A_2=(r+r')\Pi s \qquad \text{Equation 1}$$

Where s=a distance between the needle 50 and the seat 52 when the needle 50 is in an open position;

r=the shortest distance between the longitudinal axis 70 and the intersection of the seat 52 with the line "s"; and r'=the shortest distance between the longitudinal axis 70 and the intersection of the needle 50 with the line "s", and where $$s=\sqrt{(r-r')^2+h^2} \qquad \text{Equation 2}$$

where:

h=the projection of s along the longitudinal axis 70.

Substituting for "s" in Equation 1 yields:

$$A_2=(r+r')\Pi\sqrt{(r-r')^2+h^2} \qquad \text{Equation 3}$$

Figure 3:
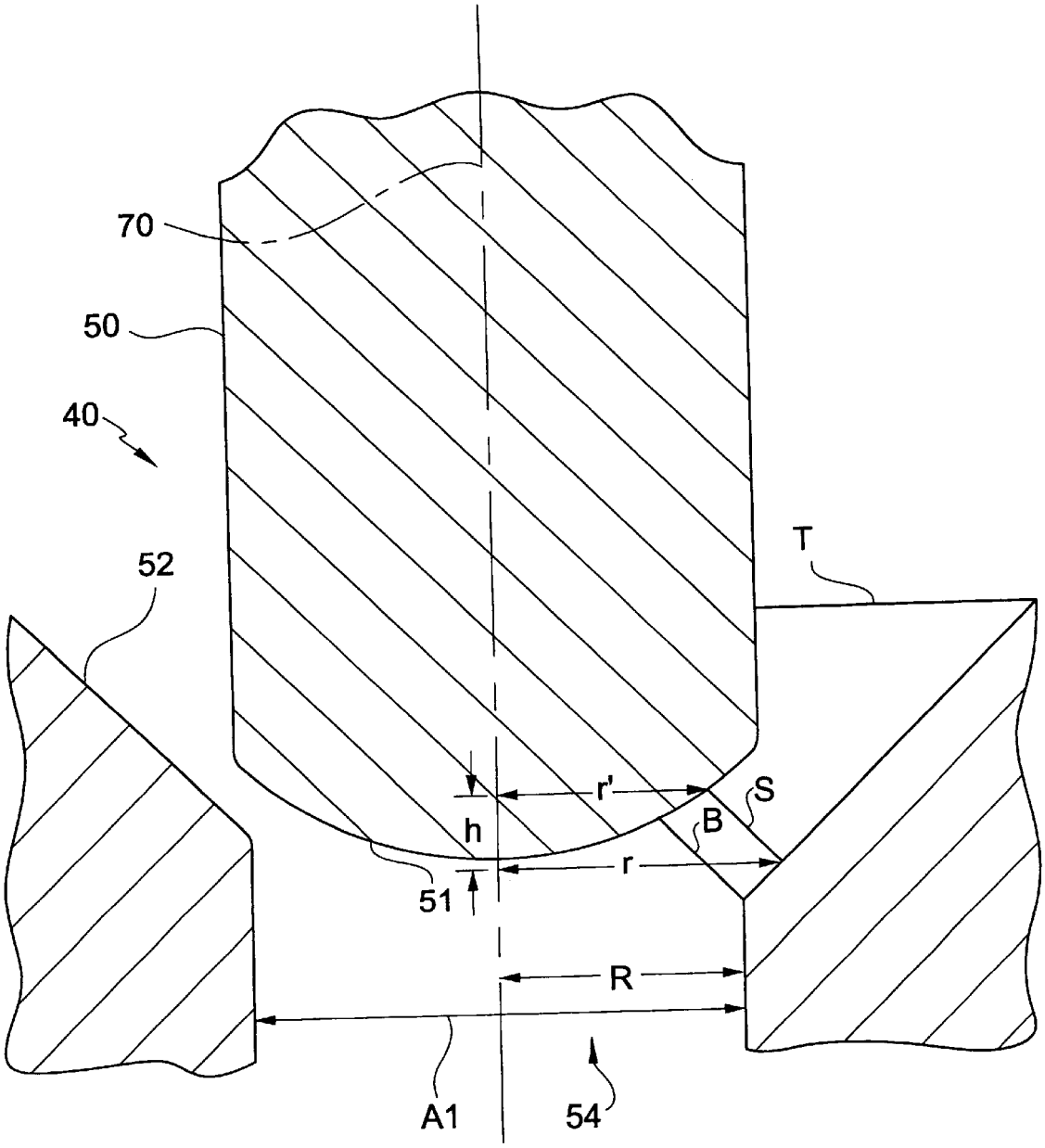
FIG. 3 is an enlarged view, in section, of the discharge end of the first fuel injector showing parameters used to determine flow rate through the first fuel injector.

The relationships between the parameters r, r', s, and h, are shown in FIG. 3. The line "s" intersects the seat 52 between the line "T" and the line "B", shown in FIG. 3. The minimum flow area $A_2$ is preferably determined through an iterative process. Those skilled in the art will recognize, and as can be seen from the above equations and FIG. 3, that the width of the needle 50, the slope of the seat 52, and the shape of the needle end 51 all determine the size of the minimum flow area $A_2$.

Refering still to FIG. 3, the flow area $A_1$ of the opening 54 is:

$$A_1=\Pi R^2 \qquad \text{Equation 4}$$

Where

R=the radius of the opening 54.

For the injector lift to influence the fuel flow rate, $$A_1>A_2. \qquad \text{Equation 5}$$

Preferably, $$A_1>2A_2. \qquad \text{Equation 6}$$

Substituting Equations 3 and 4 into Equation 6, $$\Pi R^2>(r+r')2\Pi\sqrt{(r-r')^2+h^2} \qquad \text{Equation 4}$$

For a given injector with predetermined needle and seat sizes and shapes, the size of the frusto-conical area $A_2$ is influenced by the amount of injector stroke $L_1$. The maximum flow rate through the injector 10 is solely limited by the injector stroke distance, $L_1$. Thus, altering the injector stroke $L_1$ will proportionally alter the flow rate for the injector 10 without having to change the size of the opening 54.

Figure 4:
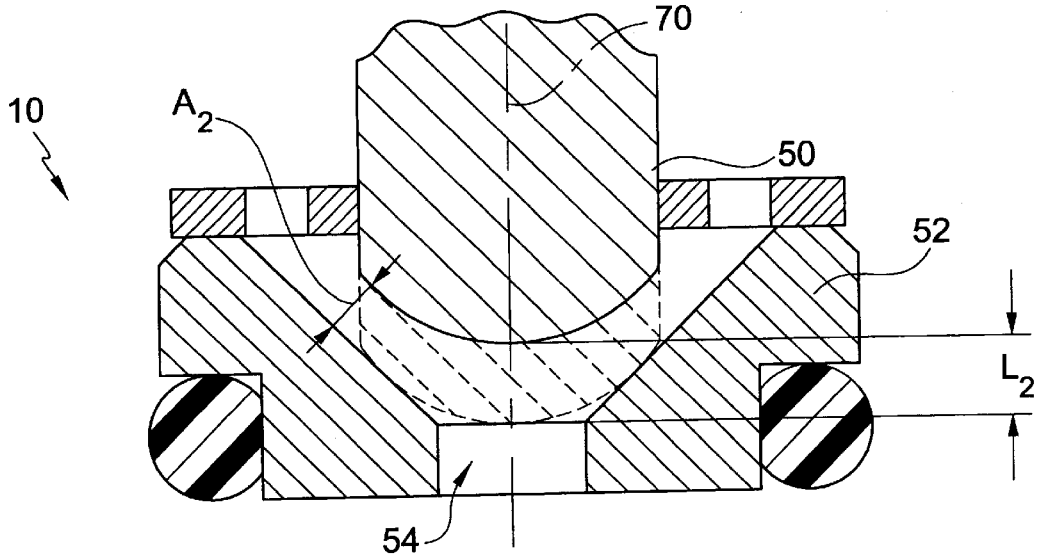
FIG. 4 is a partial view, in section, of a second fuel injector according to the invention.

A second injector 10', having substantially uniform components and dimensions as the first fuel injector 10 is shown in FIG. 4. The second fuel injector 10' is shown in the open position, with the closed position being shown in dashed lines. In the fuel injector 10', the injector stroke distance $L_2$ is greater than the injector stroke distance $L_1$. As a result, the frusto-conical area $A_2'$ is larger than the frusto-conical area $A_2$ of the first injector 10.

Figure 5:
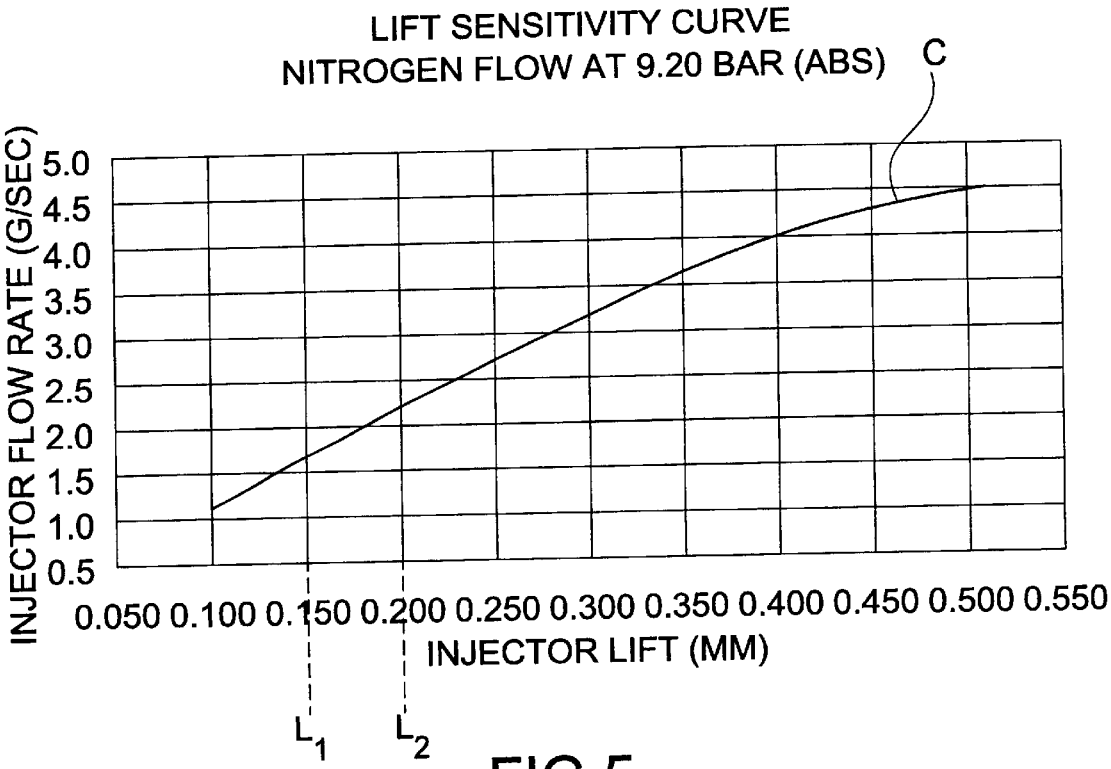
FIG. 5 is a graph showing injector lift distance versus injector flow rate.

FIG. 5 graphically compares injector stroke distance to flow rate for fuel injectors with substantially uniformly dimensioned components. The curve C in FIG. 5 was developed by flowing nitrogen at 9.29 bar (abs) through fuel injectors 10, 10' with different injector strokes $L_1$, $L_2$, as well as other fuel injectors (not shown), and measuring the fuel flow F through the injectors 10, 10'. To obtain a desired flow rate, one selects a point on the curve C corresponding to that flow rate, and sets the injector lift according to the injector stroke $L_1$, $L_2$ that corresponds to the same point on the curve C. As can be seen in FIG. 5, the curve C is never really flat, so that a particular injector stroke $L_1$, $L_2$ generally provides a corresponding flow rate, and vice versa.

Another benefit of the present invention is compatibility of parts between injectors with different flow rates. Since, for the fuel injector 10 of the present invention, flow rate is determined by injector lift $L_1$ only, the first injector 10, shown in FIG. 1, can have the first injector lift $L_1$ of, for example 0.150 millimeters and the second fuel injector 10', shown in FIG. 4, can have the second injector lift $L_2$ of, for example 0.200 millimeters. As seen in a comparison of FIGS. 1 and 4, fuel injectors 10 and 10' both have a common needle 50, seat 52, and opening cross-sectional area $A_1$, as well as all other components (not shown). The only difference between the injectors 10 and 10' is the injector lift $L_1$, $L_2$. The size of each frusto-conical area $A_2$, $A_2'$ is a function of the amount of the injector lift $L_1$, $L_2$, respectively. As seen in the graph of FIG. 5, a first lift $L_1$ of 0.150 millimeters corresponds to a flow rate of approximately 1.7 grams per second of gaseous fuel, whereas a first lift $L_2$ of 0.200 millimeters corresponds to a flow rate of approximately 2.2 grams per second of gaseous fuel. Conversely, for a desired flow rate of 2.0 grams per second of gaseous fuel, based on the curve C, an injector stroke of approximately 0.180 millimeters is desired and for a desired flow rate of 2.5 grams per second of gaseous fuel, based on the curve C, an injector stroke of approximately 0.230 millimeters is desired.

It will be apparent to those skilled in the art that various modifications and variations can be made in the fuel injector of the present invention without departing from the spirited or scope of the invention. Thus, it is intended that the present invention covers the modifications and variations of this invention provided they come within the scope of the appended claims and their equivalents.

What is claimed is:

1. A fuel injector comprising:

a housing having a hollow passage;

a longitudinal axis extending through the hollow passage;

a seat disposed at one end of the hollow passage;

a needle slidably mounted in the hollow passage and operable between a first position wherein the needle engages the seat and a second position wherein the needle is disposed away from the seat, a first flow area being formed by a minimum frusto-conical area between the seat and the needle when the needle is disposed away from the seat; and an opening at the one end of the hollow passage proximate to the seat, the opening having a second flow area larger than the first flow area.

2. A fuel injector comprising:

a housing having a hollow passage;

a longitudinal axis extending through the hollow passage;

a seat disposed at one end of the hollow passage;

a needle slidably mounted in the hollow passage and operable between a first position when the needle engages the seat and a second position when the needle is disposed away from the seat, a first flow area being formed by a minimum frusto-conical area between the seat and the needle when the needle is disposed away from the seat; and having an opening at the one end of the hollow passage proximate to the seat, the opening having a second flow area larger than the first flow area, the second flow area is approximately two times larger than the first flow area.

3. The fuel injector of claim 2, wherein the opening is in the seat.

4. The fuel injector of claim 2, wherein the first flow area is a frusto-conical area.

5. The fuel injector of claim 2, wherein the first flow area induces a first pressure drop, and the second flow area induces a second pressure drop, the second pressure drop being less than the first pressure drop.

6. A method for assembling a fuel injector having a housing and a valve disposed within the housing, the valve including a seat having an opening and a needle, the method comprising:

determining a desired fuel flow rate for the injector;

providing an opening of a first flow area in the seat to permit a fuel flow rate greater than the desired fuel flow rate; and setting an injector stroke of the needle that forms a second flow area of approximately one-half the first flow area so as to provide the desired flow rate.

7. The method of claim 6, further comprises adjusting the injector stroke so that the injector flows substantially nitrogen gas at a first flow rate through the fuel injector.

8. The method of claim 7, wherein the first flow rate is greater than 1.0 gram per second and less than or equal to 4.5 grams per second of substantially nitrogen gas flowing through the fuel injector.

9. A method for generating different flow rates from each of a plurality of fuel injectors, the method comprising:

providing substantially uniformly dimensioned components for each of the plurality of fuel injectors so that a seat provides a first flow area;

determining a desired respective gaseous flow rate for each of the plurality of fuel injectors;

setting an injector stroke with respect to each of the plurality of fuel injectors such that the injector stroke forms a second flow area between a needle and the seat of approximately one half the first flow area to provide a plurality of flow rates greater than a first flow rate; and securing the components of the first of the plurality of fuel injectors in a first position to obtain a first injector stroke and securing the components of the second of the plurality of fuel injectors in a second position to obtain a second injector stroke.

10. The method of claim 9 wherein the first injector stroke is different from the second injector stroke.

11. The method of claim 10 wherein each of the first and second injector strokes induces a first pressure drop.

12. The method of claim 11 wherein providing the substantially uniformly dimensioned components comprises providing an opening, the opening providing a respective second pressure drop.

13. The method of claim 12 wherein each of the respective second pressure drops is less than the first pressure drop.

14. The method of claim 9, wherein the providing of a first flow area comprises forming a minimum flow area by a locus of lines between a surface of the seat and a surface of the needle.

15. The method of claim 14, further comprises adjusting the injector stroke of at least one fuel injector of the plurality of fuel injectors between the first injector stroke and second injector stroke so that the at least one fuel injector flows substantially nitrogen gas at one of a rate greater than 1.0 grams per second to approximately 4.5 grams per second through the fuel injector.

16. The method of claim 15, wherein the first flow area comprises a generally circular flow area and the second flow area comprises a generally frustoconical flow area.

* * * * *